US009081354B2

(12) United States Patent
Ohno et al.

(10) Patent No.: US 9,081,354 B2
(45) Date of Patent: Jul. 14, 2015

(54) IMAGE FORMING APPARATUS

(71) Applicant: CANON KABUSHIKI KAISHA, Tokyo (JP)

(72) Inventors: Masaru Ohno, Ebina (JP); Shinji Katagiri, Yokohama (JP); Yuji Kawaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 13/897,692

(22) Filed: May 20, 2013

(65) Prior Publication Data

US 2013/0315616 A1 Nov. 28, 2013

(30) Foreign Application Priority Data

May 28, 2012 (JP) ..... 2012-121214

(51) Int. Cl.
*G03G 21/00* (2006.01)
*G03G 15/16* (2006.01)

(52) U.S. Cl.
CPC ..... *G03G 21/0047* (2013.01); *G03G 15/161* (2013.01); *G03G 2215/0132* (2013.01)

(58) Field of Classification Search
CPC ..... G03G 15/161; G03G 21/0047
USPC ..... 399/71, 101, 129, 354
See application file for complete search history.

(56) References Cited

U.S. PATENT DOCUMENTS 7,433,626 B2 * 10/2008 Takeuchi ..... 399/101
7,978,998 B2 * 7/2011 Nakagawa et al. ..... 399/101
8,027,612 B2 * 9/2011 Soda ..... 399/101
8,180,247 B2 * 5/2012 Nakagawa et al. ..... 399/101
8,238,782 B2 * 8/2012 Soda ..... 399/101
8,532,531 B2 * 9/2013 Shimura et al. ..... 399/129
8,639,154 B2 * 1/2014 Ishizumi et al. ..... 399/101
8,693,904 B2 * 4/2014 Ishizumi et al. ..... 399/50
2008/0253807 A1 * 10/2008 Soda ..... 399/175
2009/0232530 A1 9/2009 Saito et al.
2011/0150524 A1 * 6/2011 Ishizumi et al. ..... 399/101
2011/0150532 A1 * 6/2011 Shimura et al. ..... 399/175
2011/0188881 A1 * 8/2011 Akizuki et al. ..... 399/99
2011/0268469 A1 * 11/2011 Ishizumi et al. ..... 399/101
2012/0027453 A1 * 2/2012 Watanabe et al. ..... 399/101
2012/0106998 A1 * 5/2012 Ishizumi et al. ..... 399/50
2013/0108313 A1 * 5/2013 Katagiri et al. ..... 399/101
2014/0147146 A1 * 5/2014 Kobayashi et al. ..... 399/66

FOREIGN PATENT DOCUMENTS

JP H09-50167 A 2/1997
JP H11-184265 A 7/1999
JP 2009-205012 A 9/2009

* cited by examiner

*Primary Examiner* — David Gray
*Assistant Examiner* — Carla Therrien
(74) *Attorney, Agent, or Firm* — Fitzpatrick, Cella, Harper & Scinto

(57) ABSTRACT

A high-voltage power source can change a set value of a current to be supplied to an electroconductive brush from a first set current that has been set when the image formation has been started, to a second set current smaller than the first set current, at a previously set timing after the image formation for a recording material has been started. An absolute value of a potential difference between potentials of a photosensitive drum and an intermediate transfer belt, when a secondary transfer residual toner that has been charged by the electroconductive brush to which the second set current has been supplied is positioned in a primary transfer portion, is not larger than an absolute value of a potential difference which is shown when a toner image formed on the photosensitive drum is primarily transferred in the primary transfer portion.

10 Claims, 12 Drawing Sheets

IMAGE FORMING APPARATUS

BACKGROUND OF THE INVENTION

1. Field of the Invention

The present invention relates to an image forming apparatus such as a copying machine and a printer, which has a function for forming an image on a recording material such as a sheet.

2. Description of the Related Art

An image forming apparatus having such a structure as to use an intermediate transfer member is conventionally known as an image forming apparatus such as a copying machine and a laser beam printer. The image forming apparatus, firstly, transfers a toner image which has been formed on the surface of a photosensitive drum (image bearing member) onto an intermediate transfer member, in a primary transferring step. After that, the image forming apparatus repeats the primary transferring step on respective toner images of a plurality of colors, and thereby forms a toner image having the plurality of the colors on the surface of an intermediate transfer member. Subsequently, in a secondary transferring step, the image forming apparatus transfers the toner image having the plurality of the colors, which has been formed on the surface of the intermediate transfer member, collectively onto the surface of the recording material such as paper. On the recording material onto which the toner image has been collectively transferred, the toner image is permanently fixed by a fixing device, and thereby a full color image is formed. A residual toner (secondary transfer residual toner) which has remained on the intermediate transfer member after the secondary transferring step needs to be cleaned for the purpose of preparing for the next image formation. Japanese Patent Application Laid-Open No. H09-50167 proposes a cleaning method as follows. The cleaning method includes firstly applying an alternating voltage to a charging device using an electroconductive roller, and charging the secondary transfer residual toner existing on the intermediate transfer member after the secondary transferring step to a reverse polarity of the polarity of the toner, which has been charged in development. After that, the secondary transfer residual toner which has been charged to the reverse polarity moves to the photosensitive drum, and is collected by a cleaning unit on the photosensitive drum.

Furthermore, Japanese Patent Application Laid-Open No. 2009-205012 proposes a method of using an electroconductive brush (brush member) as a charging device, which comes in contact with the intermediate transfer member without being moved or rotated while the intermediate transfer member moves. Specifically, the electroconductive brush can approximately uniformly scatter and charge the secondary transfer residual toner on the intermediate transfer member. In contrast to the structure in Japanese Patent Application Laid-Open No. H09-50167, the structure in Japanese Patent Application Laid-Open No. 2009-205012 can uniformly charge the secondary transfer residual toner existing on the intermediate transfer member only with a direct voltage, without using the alternating voltage.

However, in the case where the electroconductive brush is adopted as the charging device, there is a concern that the charging function of the electroconductive brush deteriorates and consequently an image failure occurs due to the cleaning failure, when the number of printed sheets increases. When the electroconductive brush charges the secondary transfer residual toner, a part of the secondary transfer residual toner deposits on the electroconductive brush. When the number of the printed sheets has increased, the amount of the secondary transfer residual toners deposited on the electroconductive brush may increase, and the secondary transfer residual toner may accumulate in the electroconductive brush. When the amount of the secondary transfer residual toners deposited on the electroconductive brush increases, an apparent resistance of the electroconductive brush increases. In this case, a charging capability of the electroconductive brush decreases, and the electroconductive brush cannot sufficiently charge the secondary transfer residual toner existing on the intermediate transfer member. The secondary transfer residual toner which has been insufficiently charged receives a small force from an electric field in the periphery, and resists moving to the photosensitive drum when a potential difference is small between the surface of the photosensitive drum and the intermediate transfer member. Particularly, when the secondary transfer residual toner is moved to an image forming portion on the photosensitive drum, there is a possibility that the secondary transfer residual toner which has been insufficiently charged cannot move to the photosensitive drum and remains on the intermediate transfer member, because the photosensitive drum has been exposed and has small negative polarity. When the secondary transfer residual toner which has been insufficiently charged has remained on the intermediate transfer member together with an image which has been transferred from the photosensitive drum, there is a concern that an image failure occurs which originates in a phenomenon that a toner of the next image results in overlapping with the remaining secondary transfer residual toner of the prior image on the intermediate transfer member, which has not been completely collected.

SUMMARY OF THE INVENTION

An object of the present invention is to suppress the deterioration of a charging function of a charging member and simultaneously suppress the occurrence of an image failure due to a cleaning failure.

In order to achieve the above objects, the image forming apparatus according to the present invention includes: an image bearing member configured to bear a toner image; an endless and movable intermediate transfer member from which a toner image, that has been primarily transferred to the intermediate transfer member from the image bearing member in a primary transfer portion, is secondarily transferred to a recording material in a secondary transfer portion; a charging device which is arranged in a downstream side of the primary transfer portion and an upstream side of the secondary transfer portion in a moving direction of the intermediate transfer member and enabling to charge residual toner on the intermediate transfer member, the charging device including a supporting portion and a brush member, that is supported by the supporting portion so as not to be rotated while the intermediate transfer member moves, has electroconductivity and comes in contact with the intermediate transfer member; a power source portion which applies voltage to the charging device in a predetermined range; and a control unit configured to change voltage to be applied to the charging device from the power source portion so that a current that flows in the charging device becomes a predetermined current value, and further control a potential difference between potentials of the image bearing member and the intermediate transfer member in the primary transfer portion, the control portion configured to set at least a first current value and a second current value which has an absolute value smaller than that of the first current value, as the predetermined current value, and set the potential difference, at the time when the residual toner which has been charged by the charging device at the time when the second current value has been set reaches the primary transfer portion, so as to be larger than the potential difference at the time when the first current value has been set.

In order to achieve the above objects, another image forming apparatus according to the present invention includes: an image bearing member configured to bear a toner image; an endless and movable intermediate transfer member from which a toner image, that has been primarily transferred to the intermediate transfer member from the image bearing member in a primary transfer portion, is secondarily transferred to a recording material in a secondary transfer portion; a charging device which is arranged in a downstream side of the primary transfer portion and an upstream side of the secondary transfer portion in a moving direction of the intermediate transfer member and enabling to charge a residual toner on the intermediate transfer member, the charging device including a supporting portion and a brush member, that is supported by the supporting portion so as not to be rotated while the intermediate transfer member moves, has electroconductivity and comes in contact with the intermediate transfer member; a power source portion which applies voltage to the charging device in a predetermined range; and a control unit configured to control a potential difference between potentials of the image bearing member and the intermediate transfer member in the primary transfer portion, the control portion configured to set at least a first voltage and a second voltage which has an absolute value smaller than that of the first voltage, as a voltage when charging the residual toner, and set the potential difference, at the time when the residual toner which has been charged by the charging device at the time when the second voltage has been set reaches the primary transfer portion, so as to be larger than the potential difference at the time when the first voltage has been set.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments for carrying out the present invention will be illustratively described in detail below with reference to the drawings. However, the dimensions, materials, shapes, relative arrangements and the like of the components which are described in the following embodiments should be appropriately changed according to the structure and various conditions of an apparatus to which the present invention is applied, and are not intended to limit the scope of the present invention to the following embodiments.

Exemplary Embodiment 1

Image Forming System

Figure 1:
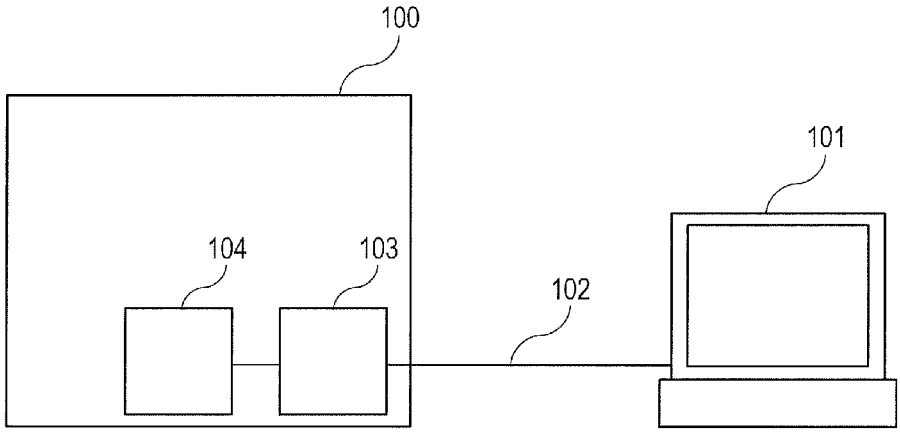
FIG. 1 illustrates the connection between an image forming apparatus of Exemplary Embodiment 1 and an image transmitting apparatus.

FIG. 1 is a view of an image forming system illustrating the connection between an image forming apparatus of the present exemplary embodiment and an image transmitting apparatus. As illustrated in FIG. 1, an image forming apparatus 100 of the present exemplary embodiment is connected to an information equipment 101 such as a PC, through a cable 102. When an image signal is transmitted to the image forming apparatus 100 from the information equipment 101, the received signal is analyzed by an image processing portion 103 in the image forming apparatus 100, and then is transmitted to a control portion 104 as a control unit. The control portion 104 controls each portion of the image forming apparatus according to the information which has been analyzed by the image processing portion 103.

(Operation of Image Forming Apparatus)

Figure 2:
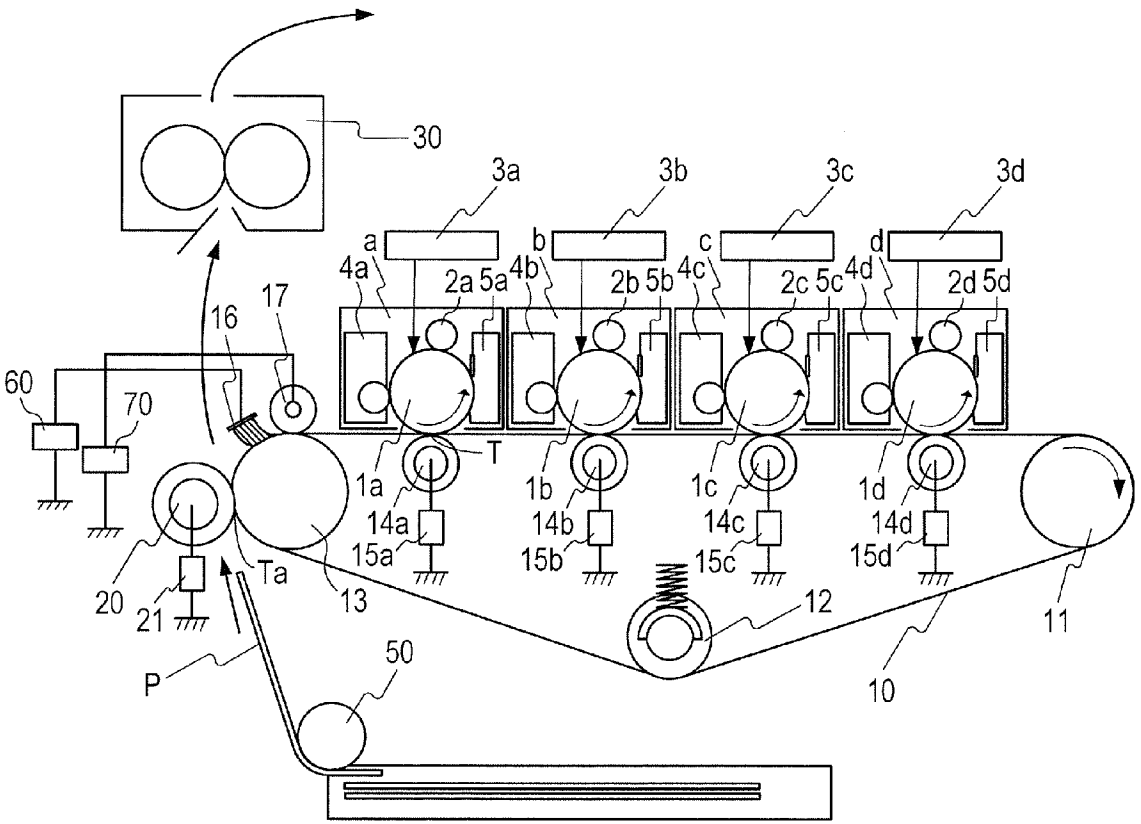
FIG. 2 is a sectional view illustrating the schematic structure of the image forming apparatus of Exemplary Embodiment 1.

FIG. 2 is a sectional view illustrating the schematic structure of the image forming apparatus 100 of the present exemplary embodiment. The structure and the operation of the image forming apparatus 100 of the present exemplary embodiment will be described below with reference to FIG. 2. The image forming apparatus 100 of the present exemplary embodiment includes first to fourth image forming stations (image forming portions) a to d. In the first to fourth image forming stations a to d, image forming operations are performed with the use of toners of colors of yellow (Y), magenta (M), cyan (C) and black (Bk), respectively. The image forming operation will be described below. The image forming operation of the first image forming station a will be described below, but the structures and the operations of the respective image forming stations are substantially the same except that the colors of the toners to be used are different from each other. When elements in the following description are not particularly needed to be distinguished from each other, the suffixes of a, b, c and d will be omitted which are given to the reference numerals in FIG. 2 so as to indicate that the element is provided for any one of the colors, and the operations will be collectively described.

The image forming apparatus 100 includes a drum-shaped electrophotographic photosensitive member 1 (hereinafter referred to as photosensitive drum) as an image bearing member, and the photosensitive drum 1 is rotationally driven in an arrow direction illustrated in FIG. 2 at a peripheral speed (process speed) of 100 mm/sec. The photosensitive drum 1*a* is uniformly charged into a predetermined polarity/potential by a charging roller 2*a* as a charging device in the process of being rotated, and then the image is exposed by an exposure unit 3*a*. The potential (light portion potential VL) in the portion exposed on the surface of the photosensitive drum 1*a* has smaller polarity than that of the potential (dark portion potential Vd) in the portion unexposed. Thereby, an electrostatic latent image corresponding to the image of a yellow color component out of a target color image is formed on the photosensitive drum 1*a*. Subsequently, the electrostatic latent image on the photosensitive drum 1*a* (on the image bearing member) is developed at a developing position by the first developing device (yellow developing device) 4*a*, and is visualized as a yellow toner image on the photosensitive drum 1*a*.

An endless rotatable intermediate transfer belt 10 as an intermediate transfer member is suspended around suspending members (11, 12 and 13). The intermediate transfer belt 10 is rotationally driven in such a direction as to move in the same direction as the moving direction of the photosensitive drum 1 on an abutting portion at which the intermediate transfer belt 10 abuts on the photosensitive drum 1, at an approximately same peripheral speed as that of the photosensitive drum 1. The suspending member includes a driving roller 11, a tension roller 12 and a secondary transfer opposing roller 13. The yellow toner image formed on the photosensitive drum 1*a* is transferred (primary transfer), in a process of passing through a primary transfer portion T, onto the intermediate transfer belt 10 (onto the intermediate transfer member) by a primary transfer voltage which has been applied to a primary transfer roller 14*a* by a primary transfer power source 15*a*. The primary transfer portion T is an abutting portion between the intermediate transfer belt 10 and the photosensitive drum 1*a* (primary transfer nipping portion formed between photosensitive drum 1*a* and intermediate transfer belt 10). In FIG. 2, only the primary transfer portion of the first image forming station a is denoted by T for the sake of convenience of description. A primary transfer residual toner (residual toner) which has remained on the surface of the photosensitive drum 1*a* is cleaned and removed by a cleaning device 5*a* as a collecting member, and then is subjected to an image forming process subsequent to the charging process. Subsequently, in a similar way, a magenta toner image of a second color, a cyan toner image of a third color and a black toner image of a fourth color are formed in respective image forming stations and are sequentially overlaid and transferred onto the intermediate transfer belt 10, and a composite color image corresponding to the target color image is obtained.

The toner image of the four colors on the intermediate transfer belt 10 is collectively transferred (secondary transfer), in a process of passing through a secondary transfer portion Ta, onto the surface of a recording material P which has been fed by a feeding unit 50, by a secondary transfer voltage that has been applied to a secondary transfer roller 20 by a secondary transfer power source 21. The secondary transfer portion Ta is an abutting portion between the intermediate transfer belt 10 and the secondary transfer roller 20 (secondary transfer nipping portion formed between intermediate transfer belt and secondary transfer roller 20). After that, the recording material P bearing the toner image of the four colors is introduced into a fixing device 30, and is heated and pressurized there. Thereby, the toners of the four colors are melted and mixed, and the toner is settled (fixed) on the recording material P. A full color print image is formed by the above described operations.

A secondary transfer residual toner (residual toner) which has remained on the surface of the intermediate transfer belt 10 after the second transfer is uniformly scattered and charged by an electroconductive brush 16 as a brush member (charging device) having electroconductivity. After that, an electric charge is given by an electroconductive roller 17. At this time, the secondary transfer residual toner is charged to a reverse polarity of a normal polarity of the toner by the electroconductive brush 16 and the electroconductive roller 17, and thereby is moved to the photosensitive drum 1*a* from the intermediate transfer belt 10. (In the present exemplary embodiment, normal polarity of toner shall be negative polarity.) After that, the secondary transfer residual toner deposited on the photosensitive drum 1*a* is removed by the cleaning device 5*a*. A movement of the charged secondary transfer residual toner (residual toner) to the photosensitive drum 1*a* from the intermediate transfer belt 10 will be occasionally referred to as reverse transfer as well, in the following description. As illustrated in FIG. 2, the electroconductive brush 16 and the electroconductive roller 17 are provided in a downstream side of the secondary transfer portion Ta in the rotative direction of the intermediate transfer belt 10, and in an upstream side of the primary transfer portion T of the first image forming station a. Voltage is supplied to the electroconductive brush 16 by a high-voltage power source 60, and thereby the electroconductive brush 16 charges the residual toner on the intermediate transfer belt 10 to the reverse polarity of the normal charge polarity of the toner.

(Transfer Structure)

An endless belt with a thickness of 100 μm made from a polyimide resin of which the volume resistivity has been adjusted to $1\times10^9$ Ω·cm by mixing carbon as an electroconductive agent is used in the intermediate transfer belt 10. The intermediate transfer belt 10 is suspended by three axes of the driving roller 11, the tension roller 12 and the secondary transfer opposing roller 13, and is suspended by a tension of 60 N by a total pressure, which is given by the tension roller 12. In the present exemplary embodiment, the polyimide resin was used as a material of the intermediate transfer belt 10, but other materials may be used as long as the material is a thermoplastic resin. Materials, for instance, such as polyester, polycarbonate, polyarylate and polyvinylidene fluoride (PVdF) may be used.

The primary transfer roller 14 has a nickel-plated steel bar which has an outer diameter of 6 mm and is covered with a foamed sponge that contains an NBR (nitrile rubber) and an epichlorohydrin rubber as main components and is adjusted so as to have a volume resistivity of $10^7$ Ω·cm and a thickness of 3 mm, and the primary transfer roller 14 has an outer diameter of 12 mm. The primary transfer roller 14 abuts on the photosensitive drum 1 through the intermediate transfer belt 10 with a pressurizing force of 9.8 N, and rotates so as to follow the rotation of the intermediate transfer belt 10. When the toner on the photosensitive drum 1 is primarily transferred, a voltage of 1,500 V is applied to the primary transfer roller 14.

The secondary transfer roller 20 has a nickel-plated steel bar which has an outer diameter of 8 mm and is covered with a foamed sponge that contains an NBR and an epichlorohydrin rubber as main components and is adjusted so as to have a volume resistivity of $10^8$ Ω·cm and a thickness of 5 mm, and the secondary transfer roller 20 has an outer diameter of 18 mm. The secondary transfer roller abuts on the intermediate transfer belt 10 with a pressurizing force of 50 N, and rotates while following the intermediate transfer belt 10. When the toner on the intermediate transfer belt 10 is secondarily transferred to the recording material P, a voltage of 2,500 V is applied to the secondary transfer roller 20 from the secondary transfer power source 21.

(Charging Device for Secondary Transfer Residual Toner)

In the present exemplary embodiment, the electroconductive brush 16 and the electroconductive roller 17 are used as a charging device for charging the secondary transfer residual toner. The electroconductive fiber which constitutes the electroconductive brush 16 contains nylon as a main component, and carbon is used as an electroconductive agent. The resistance value per unit length of one electroconductive fiber is $1\times10^{12}$ Ω/cm, and the fineness of a single fiber is 300 T/60 F (5 dtex). The density of the electroconductive fiber of the electroconductive brush 16 is 100 kF/inch$^2$. A predetermined voltage is applied to the electroconductive brush 16 from the high-voltage power source 60, and thereby the electroconductive brush 16 charges the secondary transfer residual toner.

Figure 4:
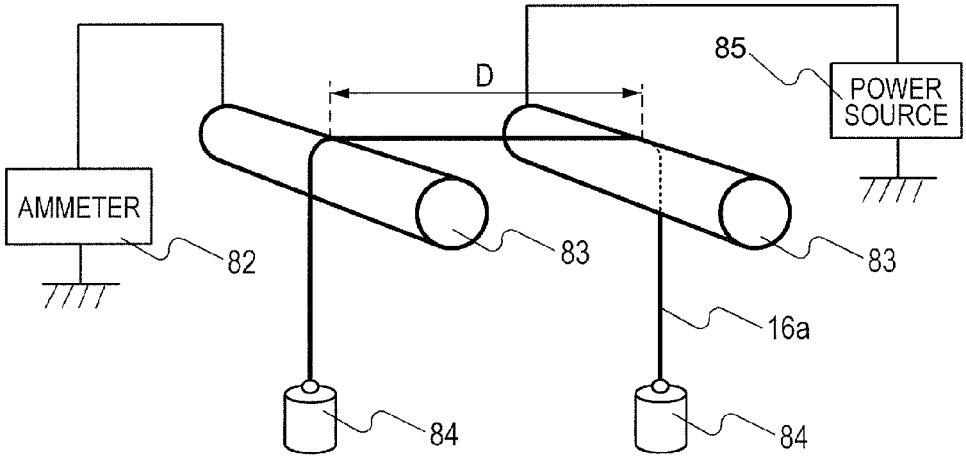
FIG. 4 illustrates a method for measuring a resistance of an electroconductive fiber in Exemplary Embodiment 1.
Figure 12:
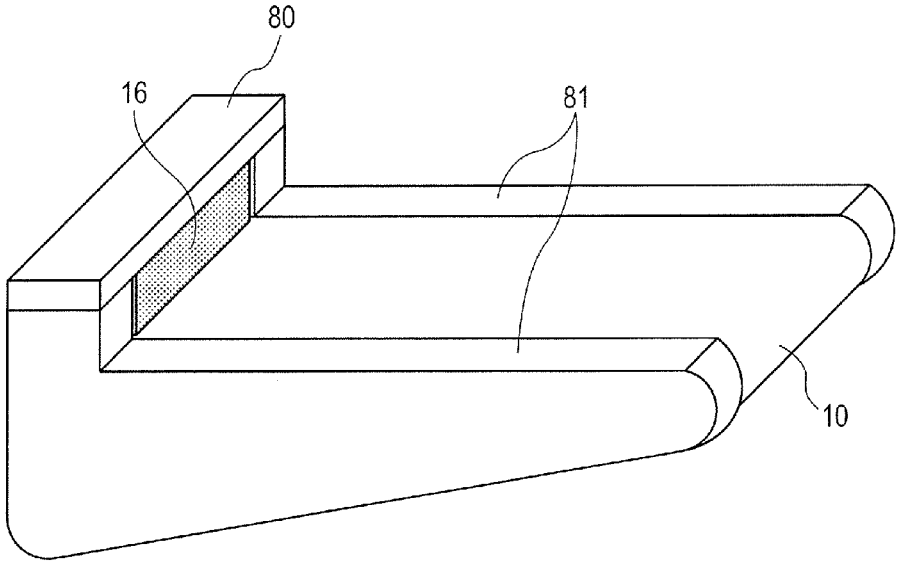
FIG. 12 is a schematic view for describing a supporting portion for the electroconductive brush.

The electroconductive brush 16 is supported by a supporting portion 80 which is illustrated in FIG. 12, and is not rotated with respect to the supporting portion by the rotation of the belt. A plurality of the electroconductive fibers continues contacting the belt. The supporting portion 80 is supported by a unit frame 81 which constitutes an intermediate transfer unit. A method for measuring a resistance of the electroconductive fiber 16*a* will be described below with reference to FIG. 4. As illustrated in FIG. 4, the electroconductive fiber 16*a* as an object to be measured is suspended by two metal rollers 83 having a diameter ϕ of 5 mm, which are arranged so as to have a width D (10 mm) between the rollers, and a load is applied to the electroconductive fiber by weights 84 of which the one side is 100 g. In this state, a voltage of 200 V is applied to the electroconductive fiber 16*a* through the metal roller 83 from the power source 85, the current value at this time is read out by an ammeter 82, and the resistance value (Ω/cm) of the electroconductive fiber 16*a* per 10 mm (1 cm) is calculated.

An elastic roller which contains a urethane rubber having a volume resistivity of $10^9$ Ω·cm as a main component is used as the electroconductive roller 17. The electroconductive roller 17 is pressurized against the secondary transfer opposing roller 13 through the intermediate transfer belt 10 with a total pressure of 9.8 N by a not-shown spring, and rotates so as to follow the rotation of the intermediate transfer belt 10. A voltage of 1,500 V is applied to the electroconductive roller 17 from the high-voltage power source 70, and the electroconductive roller 17 charges the secondary transfer residual toner. In the present exemplary embodiment, urethane rubber has been used as the electroconductive roller 17, but the material of the electroconductive roller 17 is not limited to the urethane rubber in particular and may also be NBR, EPDM (ethylene propylene rubber), epichlorohydrin and the like.

(Method for Cleaning Intermediate Transfer Belt)

In the above described structure, a method for cleaning the intermediate transfer belt 10 will be described below with reference to FIG. 3. In the present exemplary embodiment, the toner is charged to negative polarity in the developing device 4, then is used for development on the photosensitive drum 1, and is primarily transferred to the intermediate transfer belt 10 from the surface of the photosensitive drum 1 by the primary transfer roller 14 to which the voltage of the positive polarity has been applied by the primary transfer power source 15. After that, the toner on the intermediate transfer belt 10 is secondarily transferred to the recording material P by the secondary transfer roller 20 to which the voltage of the positive polarity has been applied by the secondary transfer power source 21, and thereby the image is formed.

Figure 3:
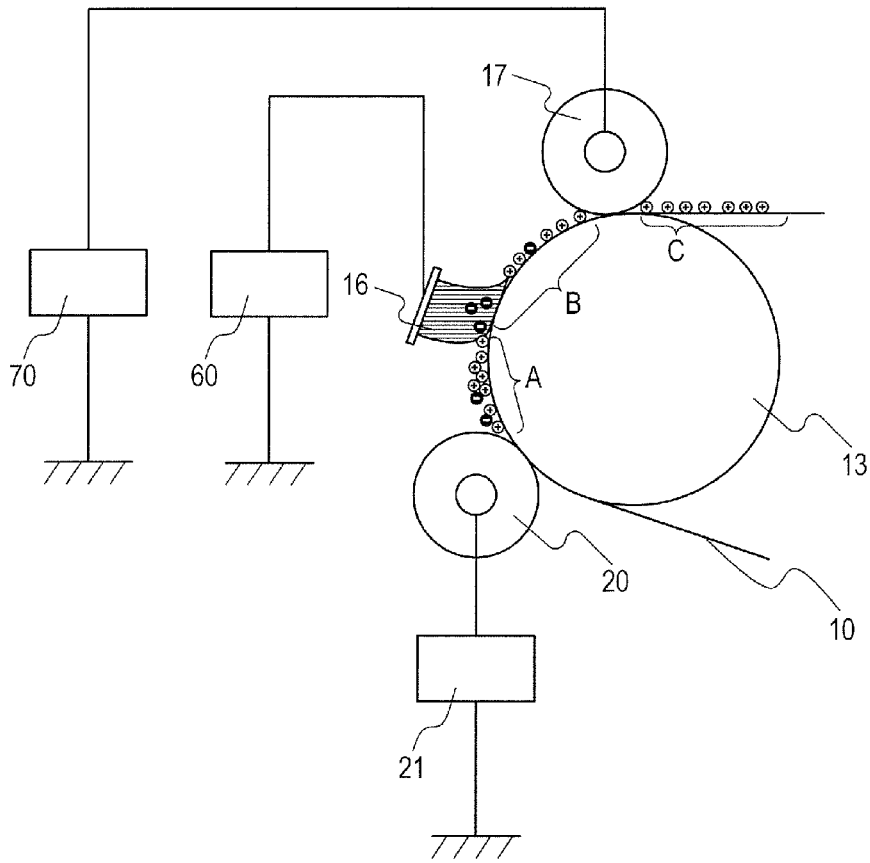
FIG. 3 illustrates a cleaning method for an intermediate transfer belt of Exemplary Embodiment 1.

As illustrated in FIG. 3, both of a toner having the positive polarity and a toner having the negative polarity coexist in the secondary transfer residual toners which have remained on the intermediate transfer belt 10 after the secondary transfer, due to the influence of the voltage of the positive polarity which has been applied to the secondary transfer roller 20. The secondary transfer residual toners receive the influence of the unevenness of the surface of the recording material P, and remain on the intermediate transfer belt 10 in a state of being locally overlaid and forming a plurality of layers (toners existing in range shown by "A" in FIG. 3). The electroconductive brush 16 which is positioned in the more upstream side in the rotative direction of the intermediate transfer belt 10 than the four image forming stations is fixed and arranged with respect to the intermediate transfer belt 10 that rotationally moves, and is arranged so that an intrusion amount to the intermediate transfer belt 10 becomes a predetermined intrusion amount. Because of this, the secondary transfer residual toner which has been stacked on the intermediate transfer belt 10 so as to form a plurality of layers is mechanically scattered by a peripheral speed difference between the electroconductive brush 16 and the intermediate transfer belt 10 to become the height corresponding to approximately one layer (toner in range shown by "B" in FIG. 3), when passing through the electroconductive brush 16.

The voltage of the positive polarity is applied to the electroconductive brush 16 from the high-voltage power source 60. By performing a method of constant current control, the secondary transfer residual toner is charged to the positive polarity which is the reverse polarity of the (normal) polarity of the toner in the development, when passing through the electroconductive brush 16. The constant current control means that a control portion 140 controls the voltage to be applied from the high-voltage power source 60 so that the value of the current passing through the charging device is kept at a predetermined current value. The high-voltage power source 60 applies a direct voltage to the electroconductive brush 16, and can apply a voltage of 3,000 V at the maximum. If the high-voltage power source is a power source which can apply a voltage of 3,000 V or higher, the size of the high-voltage power source increases, and the cost of the high-voltage power source results in increasing. The negative polarity toner in the secondary transfer residual toners, which has not been charged to the positive polarity when having passed through the electroconductive brush 16, is primarily collected by the electroconductive brush 16. After that, the secondary transfer residual toner which has passed through the electroconductive brush 16 is moved in the rotative direction of the intermediate transfer belt 10, and reaches the electroconductive roller 17. The voltage (in the present exemplary embodiment, 1,500 V) of the positive polarity is applied to the electroconductive roller 17 by a high-voltage power source 70. The secondary transfer residual toner which has passed through the electroconductive brush 16 and has been charged to the positive polarity is further charged when passing through the electroconductive roller 17, and thereby an optimum positive charge for being reversely transferred to the photosensitive drum 1*a* in the primary transfer portion T is given to the secondary transfer residual toner (toner in range shown by "C" in FIG. 3). The secondary transfer residual toner to which the optimum electric charge has been given is reversely transferred to the photosensitive drum 1*a* in the primary transfer portion T of the first image forming station a, by the voltage of the positive polarity that has been applied to the primary transfer roller 14*a*, and is collected into the cleaning device 5*a* which is arranged on the photosensitive drum 1*a*. The toner which has been primarily collected by the electroconductive brush 16 and the toner deposited on the electroconductive roller 17 are moved to the intermediate transfer member 10 during a post-rotation operation to be carried out when the image forming operation has been completed. An operation of moving the toner from the electroconductive brush 16 to the intermediate transfer member 10 is hereafter referred to as the operation of discharging the toner. The first image forming station a is an image forming station which is positioned in the most upstream side in the rotative direction of the intermediate transfer belt 10 among the plurality of the image forming stations. When the secondary transfer residual toner on the intermediate transfer belt 10 is reversely transferred to the photosensitive drum 1*a* in the primary transfer portion T, at the timing when the toner image formed on the photosensitive drum 1*a* is primarily transferred to the intermediate transfer belt 10, so-called cleaning simultaneous with transfer is conducted. According to such structure, thereby cleaning in the primary transfer for the next page can be performed, and images can be formed continuously without decreasing the printing speed.

Figure 13:
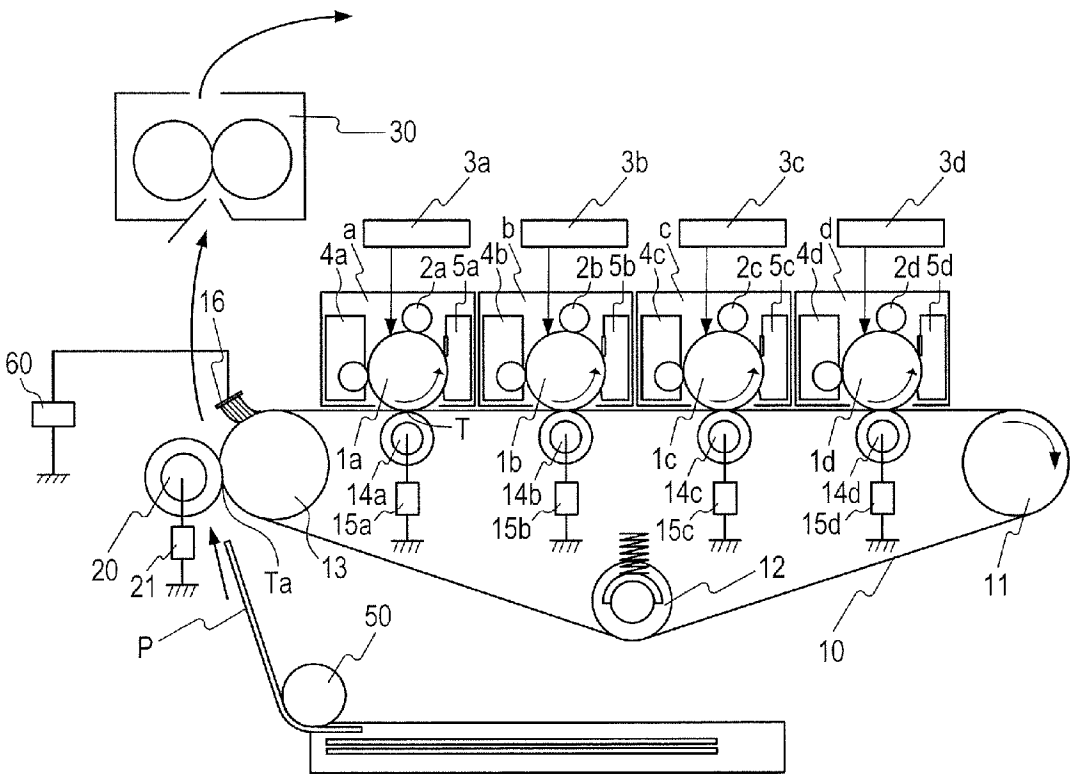
FIG. 13 is a sectional view illustrating a schematic structure of another image forming apparatus of Exemplary Embodiment 1.

In the present exemplary embodiment, the electroconductive roller 17 is arranged in the downstream side in the rotative direction of the intermediate transfer belt 10 than the electroconductive brush 16, but the purpose is to more uniformize the amount of charge amount of the toner after having passed through the electroconductive brush 16. Accordingly, if the charge amount of the secondary transfer residual toner is within a predetermined range even though there is no electroconductive roller 17, the secondary transfer residual toner can be charged only by the electroconductive brush 16 as in the image forming apparatus illustrated in FIG. 13. The charge amount of the secondary transfer residual toner varies depending on environments such as temperature and humidity in the secondary transfer, the charge amount of the toner on the intermediate transfer belt 10, the type of the recording material and the like in many cases, and the image forming apparatus can address the fluctuation of the charge amount of the secondary transfer residual toner by using the electroconductive roller 17.

(Features of Present Exemplary Embodiment)

The present exemplary embodiment is characterized in that a control described below is conducted. Firstly, after the whole of the primary transferring step during the printing operation (image forming operation) has been completed, a set current for the electroconductive brush 16 is changed from a first set current (first current value) to a second set current (second current value) which is smaller than the first set current. The set current is set as a predetermined current value in the constant current control. After that, the surface potential of the photosensitive drum la is controlled so that the secondary transfer residual toner which has been charged by the electroconductive brush 16 to which the second set current has been applied is moved to the photosensitive drum 1*a*. The first set current and the second set current correspond to a current of a first value which is set when the image formation is started and a current of a second value which is smaller than the first value, respectively, out of the set values of the current which is supplied to the electroconductive brush 16 by the high-voltage power source 60. The high-voltage power source 60 can change the set value of the current to be supplied to the electroconductive brush 16, from the first value to the second value, by the control portion 104, at a previously set timing after the image formation for one sheet of a recording material has been started.

Figure 5:
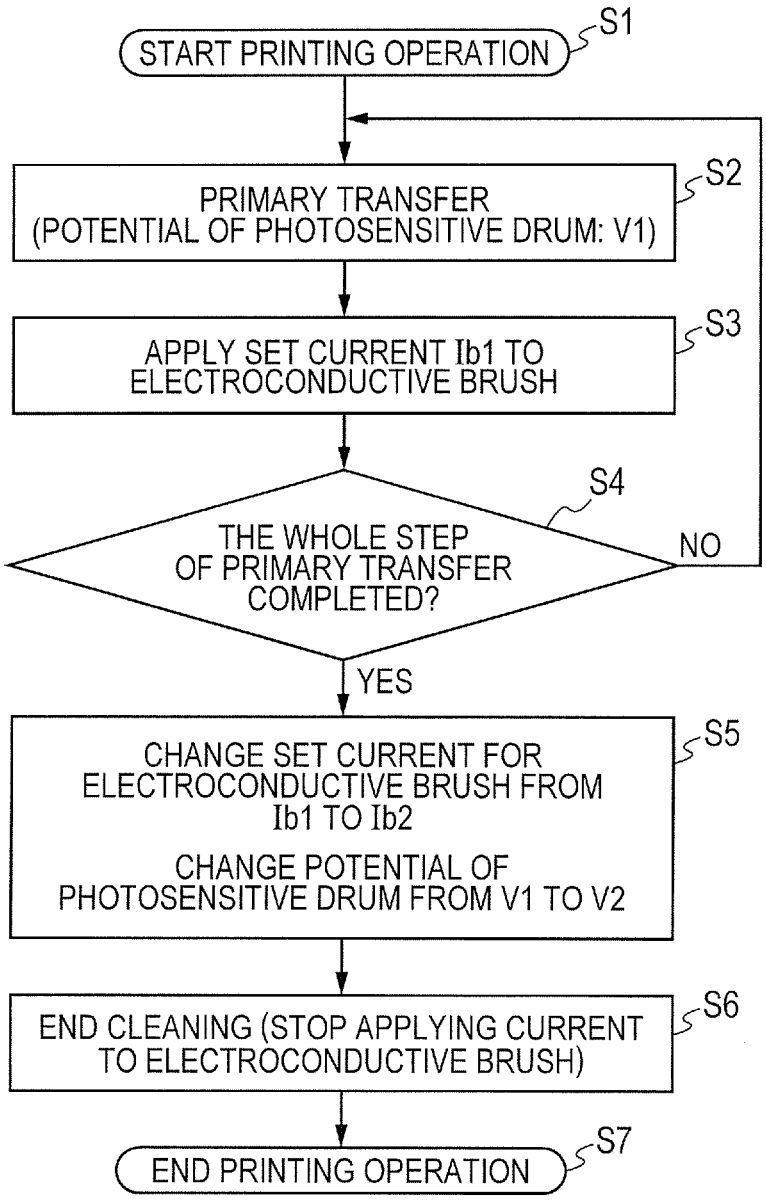
FIG. 5 is a flow chart illustrating an operation of an electroconductive brush during a printing operation in Exemplary Embodiment 1.

A specific operation of the electroconductive brush 16 during the printing operation will be described below with reference to FIG. 2 and a flow chart illustrated in FIG. 5. FIG. 5 illustrates the flow chart illustrating the processing which is carried out by a control portion 104 in an image forming apparatus 100 of the present exemplary embodiment. In S1, after an image signal has been transmitted to the image forming apparatus 100 from the information equipment 101 such as a PC, the signal is analyzed by an image processing portion 103, the control portion 104 sends instructions to each portion, and the printing operation starts. In S2, the toner images which have been developed on the photosensitive drum 1 are sequentially transferred (primarily transferred) onto the intermediate transfer belt 10. The surface potential of the photosensitive drum 1*a* in the first image forming station a at this time is determined according to a ratio of an exposed image portion (light portion potential VL) to an unexposed non-image portion (dark portion potential Vd). Accordingly, when the average potential of the surface of the photosensitive drum 1*a* in S2 is represented by V1, a relationship of $|VL| \leq |V| \leq |Vd|$ holds, in which V1 varies depending on the printing rate of the image.

In S3, the first set current Ib1 is applied to the electroconductive brush 16. In S4, it is determined whether the primary transferring step in the fourth image forming station d has been completed. When the primary transferring step has not been completed, the above described steps of S2 and S3 are repeated. When the whole of the primary transferring step of the fourth image forming station d has been completed, the high-voltage power source 60 is controlled so as to change the set current for the electroconductive brush 16 to the second set current Ib2, in S5. The average potential of the surface of the photosensitive drum 1*a* is controlled so as to become V2. In the present exemplary embodiment, in S5, the set current for the electroconductive brush 16 is changed to the second set current Ib2 by the control portion 104, at the timing when the primary transferring step in the fourth image forming station d has been completed. In S6, after the secondary transfer residual toner has passed through the electroconductive brush 16 and has been removed from the surface of the intermediate transfer belt 10, the application of the current to the electroconductive brush 16 is stopped. In S7, the printing operation is completed.

In S2, the potential VL of the light portion on the surface of the photosensitive drum 1*a* is −100 [V], and the potential Vd of the dark portion thereon is −500 [V]. Suppose that the ratio between each of the portions of VL and Vd is 50%. Then, the average potential V1 of the surface of the photosensitive drum 1*a* becomes −300 [V]. The first set current Ib1 which is applied to the electroconductive brush 16 is set at 20 [μA]. In S2 and S3, when passing through the electroconductive brush 16 to which the first set current Ib1 is applied, the secondary transfer residual toner therethrough is charged to the positive polarity, and the toner which has not been completely charged is primarily collected in the electroconductive brush 16. After that, the charged secondary transfer residual toner is moved onto the photosensitive drum 1*a* of which the average potential of the surface is V1, is removed from the surface of the photosensitive drum 1*a* by the cleaning device 5*a*, and is collected therein. At this time, in the first image forming station a, the toner image on the photosensitive drum 1*a* is transferred onto the intermediate transfer belt 10, and at the same time, cleaning simultaneous with transfer is conducted, which is an action of collecting the secondary transfer residual toner.

In S5, the average potential V2 of the surface of the photosensitive drum 1*a* is set at −500 [V] which is the same potential as the potential Vd of the dark portion, and the second set current Ib2 which is applied to the electroconductive brush 16 is set at 5 [μA]. In S5 and S6, the secondary transfer residual toner that has passed through the electroconductive brush 16 to which the set current Ib2 has been applied is charged to the positive polarity, and the toner which has not been completely charged is primarily collected in the electroconductive brush 16. After that, the charged secondary transfer residual toner is moved to the photosensitive drum 1*a* of which the average potential of the surface has been controlled to V2, is removed from the surface of the photosensitive drum 1*a* by the cleaning device 5*a*, and is collected therein. At this time, there is no toner image on the photosensitive drum 1*a*, and the transfer of the toner image onto the intermediate transfer belt 10 is not conducted. Accordingly, the toner is not removed from the surface of the intermediate transfer belt 10 in the cleaning simultaneous with transfer. In the present exemplary embodiment, the first image forming station a was described as a collecting station for the secondary transfer residual toner, but the secondary transfer residual toner may be collected in any station of the second image forming station b to the fourth image forming station d.

(Action of Present Exemplary Embodiment)

Figure 6:
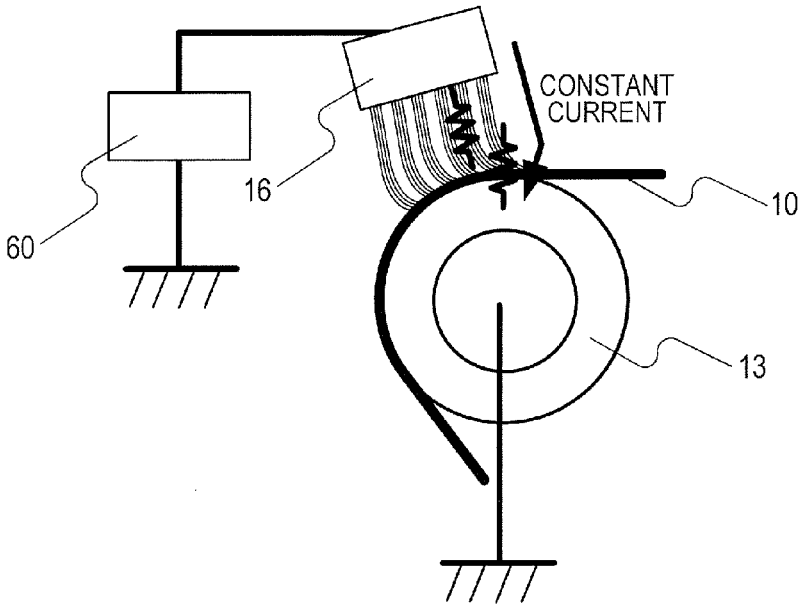
FIG. 6 illustrates a mechanism of toner recovery of the electroconductive brush in Exemplary Embodiment 1.

Next, the action of the present exemplary embodiment will be described below. The relationship between the set current for the electroconductive brush 16 and the amount of the deposited secondary transfer residual toners will be described below with reference to FIG. 6 and FIG. 7. FIG. 6 illustrates the mechanism according to which the toner is collected in the electroconductive brush 16, in the present exemplary embodiment.

Figure 7:
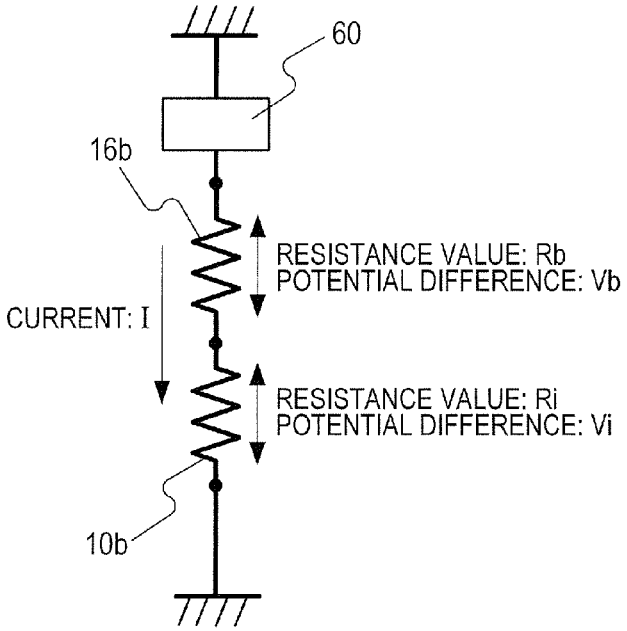
FIG. 7 is a view in which the structure illustrated in FIG. 6 is expressed by an equivalent circuit.

As illustrated in the schematic view of FIG. 6, a predetermined current is applied to the electroconductive brush 16 from the high-voltage power source 60, and passes toward the secondary transfer opposing roller 13 through the intermediate transfer belt 10, as for a current path. FIG. 7 illustrates the structure illustrated in FIG. 6 in a form of an equivalent circuit, and the state in which a current I [A] is controlled to be constant by the high-voltage power source 60. When the electric resistance values of the electroconductive brush 16 and the intermediate transfer belt 10 in the region in which both of the brush and the belt contact each other are Rb [0] and Ri [Ω], respectively, the equivalent circuit in FIG. 7 regards the respective members as a resistor 16*b* having the resistance value of Rb [Ω] and a resistor 10*b* having the resistance value of Ri [Ω]. At this time, a potential difference Vb [V] which is applied to the electroconductive brush 16 results in being Vb=Rb×I, and a potential difference Vi [V] which is applied to the intermediate transfer belt 10 results in being Vi=Ri×I. Thus, the potential differences depend on the resistance values and the passing current values of the intermediate transfer belt 10 and the electroconductive brush 16, respectively.

The voltage of the positive polarity is applied to the electroconductive brush 16, and accordingly when the secondary transfer residual toners, in which both of the toners each having the positive polarity and the negative polarity coexist, thrusts into the electroconductive brush 16, the toner having the negative polarity electrostatically deposits on the electroconductive brush 16. When the value of the current which is passed to the electroconductive brush 16 is large, a potential difference Vb between potentials at the tip and the root of the electroconductive brush 16 becomes large. Then, the force of electrostatically attracting the toner is strong, and the secondary transfer residual toner deposits on the brush tip and even onto the root of the electroconductive brush 16. On the contrary, when the value of the current which is passed to the electroconductive brush 16 is small, the potential difference Vb decreases. Then, the force of electrostatically attracting the toner becomes weak, and the amount of toners which deposit on the root of the electroconductive brush 16 decreases.

Figure 8:
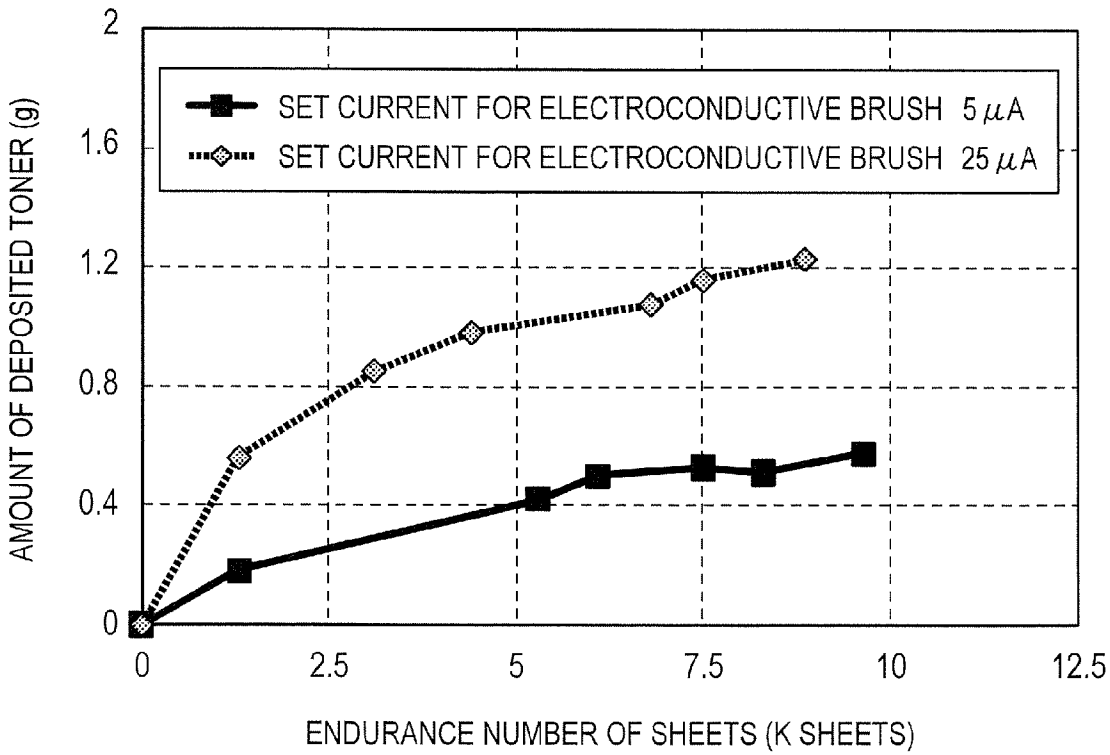
FIG. 8 illustrates a relationship between a set current for the electroconductive brush of Exemplary Embodiment 1 and the amount of deposited toners.

FIG. 8 illustrates the result of having conducted an experiment on a relationship between the set current for an electroconductive brush 16 and the amount of deposited toners. The printing operations were repeated in respective states in which a current of 5 [μA] and a current of 25 [μA] were applied to the electroconductive brush 16 as the set current for the electroconductive brush 16. Then, the amount of toners deposited on the electroconductive brush 16 to which the current of 5 [μA] was applied was approximately a half of that deposited on the electroconductive brush 16 to which the current of 25 [μA] was applied, and the relationship between the set current for the electroconductive brush 16 and the amount of the deposited secondary transfer residual toners was recognized. Accordingly, when the set current for the electroconductive brush 16 is changed from Ib1 to Ib2 which is smaller than Ib1, during the printing operation, the amount of toners deposited on the electroconductive brush 16 can be reduced by such an extent that the set current has been decreased to Ib2. Particularly, when the resistance values Rb [Ω] and Ri [Ω] of the electroconductive brush 16 and the intermediate transfer belt 10 satisfy a relationship of Rb≥Ri, and the electroconductive brush 16 on which the secondary transfer residual toner easily deposits is used, an effect of reducing the amount of deposited toners by the decrease of the set current for the electroconductive brush 16 in the present exemplary embodiment is particularly useful. In other words, a control method of varying the current shown in the present exemplary embodiment produces the effect particularly when a brush with high resistance is used as the electroconductive brush 16, and it is enabled to use the brush with the high resistance, on which the toners easily deposit, by applying the control method of the present exemplary embodiment.

Next, a cleaning operation corresponding to each of the set currents to be applied to the electroconductive brush 16 will be described below. A force, which the secondary transfer residual toner that has passed through the electroconductive brush 16 receives when being moved from the intermediate transfer belt 10, is determined by the amount of electric charge of the secondary transfer residual toner, and the potential difference generated between the photosensitive drum 1*a* and the intermediate transfer belt 10. The secondary transfer residual toner that has passed through the electroconductive brush 16 to which the first set current Ib1 has been applied and has been charged to the positive polarity is moved to the photosensitive drum 1*a* of which the average potential of the surface is V1. The average potential V1 of the surface of the photosensitive drum 1*a* at this time is determined by a ratio between each of portions having the potential VL of the light portion and the potential Vd of the dark portion, and the potential difference between potentials of the photosensitive drum 1*a* and the intermediate transfer belt 10 becomes the smallest in the case where the whole surface of the photosensitive drum 1*a* becomes VL. The electroconductive brush 16 must give the electric charge to the secondary transfer residual toner and sufficiently charge the secondary transfer residual toner so that the secondary transfer residual toner can move to the photosensitive drum 1*a* in the state in which the potential difference between potentials of the photosensitive drum 1*a* and intermediate transfer belt 10 is the minimum. For this purpose, the set current Ib1 must be set at such a value as to satisfy the above described state, and in the present exemplary embodiment, the value is determined to be 20 [μA].

On the other hand, the secondary transfer residual toner that has passed through the electroconductive brush 16 to which the second set current Ib2 has been applied and has been charged to the positive polarity moves to the photosensitive drum 1*a* which has completed the whole of the primary transferring step and of which the average potential of the surface has been controlled to V2, in the primary transfer portion T. At this time, the second set current Ib2 satisfies the relationship of Ib2<Ib1. Because of this, when the second set current Ib2 is applied to the electroconductive brush 16, the charge amount of the secondary transfer residual toner is small compared to that in the case where the first set current Ib1 is applied to the electroconductive brush 16. Because of this, the potential difference generated between the photosensitive drum 1*a* and the intermediate transfer belt 10 needs to be increased to compensate the force which is received when moving to the photosensitive drum. In the present exemplary embodiment, the average potential V2 of the surface of the photosensitive drum 1*a* is set at −500 [V] to increase the potential difference generated between the photosensitive drum 1*a* and the intermediate transfer belt 10. Thus, when the secondary transfer residual toner that has been charged by the electroconductive brush 16 to which the second set current Ib2 has been applied is positioned in the primary transfer portion T, the potential difference between potentials of the photosensitive drum 1*a* and the intermediate transfer belt 10 is set at the following magnitude. Specifically, an absolute value of the potential difference is determined not to be smaller than the absolute value of the potential difference between potentials of the photosensitive drum 1*a* and the intermediate transfer belt 10 when the toner image formed on the photosensitive drum 1*a* is primarily transferred in the primary transfer portion T, in order that the secondary transfer residual toner can move to the photosensitive drum 1*a* in the primary transfer portion T. The surface potential of the photosensitive drum 1 is determined by the ratio of the exposed image portion (potential VL of the light portion) to the unexposed non-image portion (potential Vd of the dark portion), as described above. Specifically, the surface potential of the photosensitive drum 1 can be controlled by an operation of controlling at least any one of the charging roller 2*a* and the exposure unit 3*a*. In the present exemplary embodiment, the potential difference between potentials of the photosensitive drum 1*a* and the intermediate transfer belt 10 was controlled by changing the surface potential of the photosensitive drum 1*a*, but the control method is not limited to the above method as long as the potential difference can be controlled. For instance, the primary transfer voltage to be applied to the primary transfer roller 14*a* may be controlled by the primary transfer power source 15*a*. The potential difference can be controlled by an operation of controlling at least any one of the surface potential of the photosensitive drum 1*a* and the primary transfer power source 15*a*. The surface potential of the photosensitive drum 1*a* may be controlled by the charging roller 2*a*.

Figure 9:
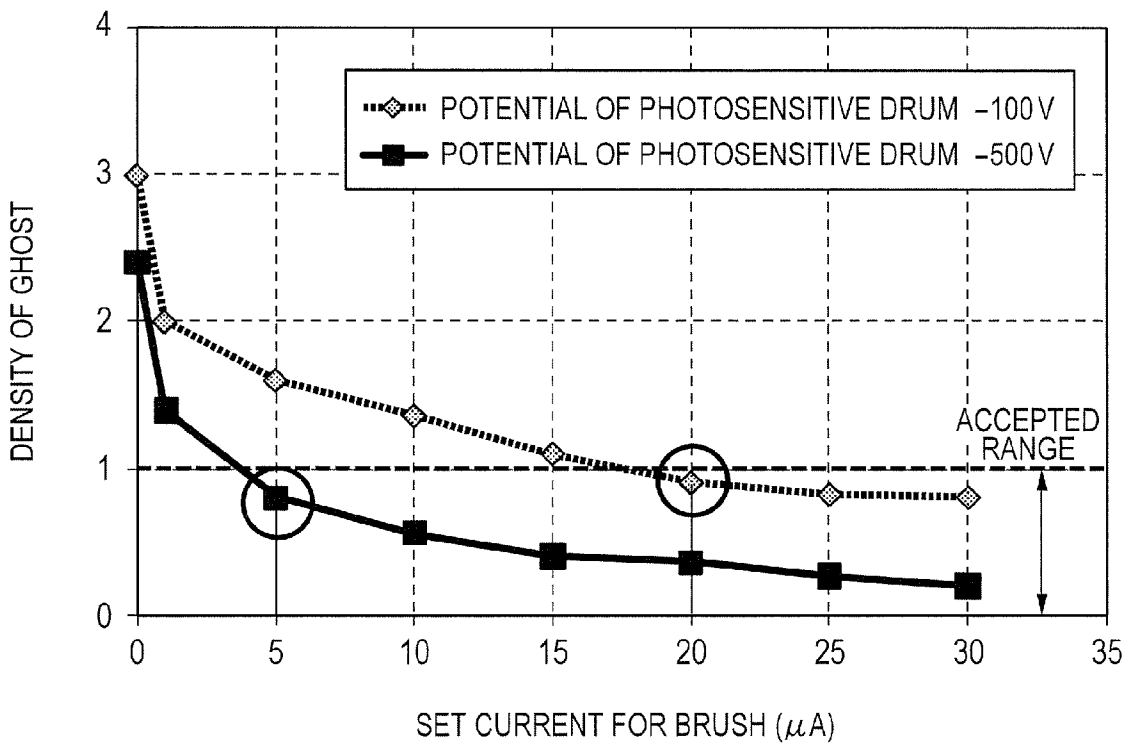
FIG. 9 illustrates a relationship between the set current for the electroconductive brush and a ghost density, with respect to the potential of the photosensitive drum.

FIG. 9 illustrates the result of having conducted an experiment on a relationship between the set current for the electroconductive brush 16 with respect to each surface potential of the photosensitive drum 1*a* and a density of a ghost. The density of the ghost means a rank obtained by ranking the density of the secondary transfer residual toner which has been insufficiently charged by the electroconductive brush 16, has not been reversely transferred to the photosensitive drum 1*a*, has remained on the intermediate transfer belt 10 and has caused an image failure, to 0 to 4, and evaluating the ranked density. The states of the image failures in each rank on the density of the ghost will be described below. The rank 0 means the state in which there is no secondary transfer residual toner on an image, the rank 1 means the state in which the secondary transfer residual toner is not obtrusive regardless of the image, the rank 2 means the state in which the secondary transfer residual toner is occasionally obtrusive depending on the type of the image, and the ranks which follow rank 3 mean the states in which the secondary transfer residual toner is obtrusive in any image.

The method for evaluating the density of the ghost includes the determination by visual observation by an evaluator, and besides, the measurement of the density of the image failure with the use of a reflection densitometry made by GretagMacbeth AG, and the result is evaluated by considering the measurement result, rounding off the value to the first decimal place and is ranked. In the present exemplary embodiment, if the density of the ghost is 1 or less, it is determined that the image forming apparatus has a sufficient cleaning performance. When the surface potential of the photosensitive drum 1*a* is −100 [V], if the set current for the electroconductive brush 16 has been set at 20 [μA], the density of the ghost becomes 0.9, which satisfies the cleaning performance. On the other hand, when the surface potential of the photosensitive drum 1*a* is −500 [V], if the set current for the electroconductive brush 16 has been set at 5 [μA], the density of the ghost becomes 0.8, which satisfies the cleaning performance. Accordingly, even when the set current for the electroconductive brush is small, the cleaning performance can be maintained by an operation of controlling the surface potential of the photosensitive drum 1*a*.

As has been described above, in the present exemplary embodiment, when the whole of the primary transferring step during the printing operation has been completed, the set current for the electroconductive brush 16 is changed from Ib1 to Ib2 which is smaller than Ib1. Thereby, the amount of the deposited toners on the electroconductive brush 16 is reduced, and an apparent increase of the resistance of the electroconductive brush 16 due to endurance running (originating in long period of use) can be suppressed. At this time, there is a concern that the secondary transfer residual toner that has passed through the electroconductive brush 16 to which the set current Ib2 has been applied is insufficiently charged, but the secondary transfer residual toner can be reversely transferred by an operation of controlling the surface potential of the photosensitive drum 1*a*. By this control, the secondary transfer residual toner can be surely charged in such a degree as to enable the cleaning simultaneous with transfer within a range of a voltage which the high-voltage power source 60 can apply, even when the apparent resistance of the electroconductive brush 16 has increased. Even the secondary transfer residual toner having a small charge amount can be adequately reversely transferred to the photosensitive drum, and accordingly a more stable cleaning performance can be obtained. Accordingly, such an image forming apparatus can be provided as to suppress the decrease of a charging function of a charging member due to the increase of the number of the printed sheets, and as to provide an adequate image quality free from an image failure which originates in a cleaning failure.

Exemplary Embodiment 2

Exemplary Embodiment 2 will be described below. In the present exemplary embodiment, a structural part different from that in Exemplary Embodiment 1 will be described, and description on a structural part similar to that in Exemplary Embodiment 1 will be omitted.

(Features of the Present Exemplary Embodiment)

The present exemplary embodiment relates to an image forming apparatus 100 having an electroconductive brush 16 as illustrated in FIG. 2, which is similar to that in Exemplary Embodiment 1. The first set current and the second set current which is smaller than the first set current are provided as the set current for the electroconductive brush 16. The image forming apparatus 100 is characterized in that the set current for the electroconductive brush 16 is changed to the second set current from the first set current during a printing operation, at the timing when the image forming apparatus 100 becomes the following state (mode).

(1) A secondary transfer residual toner which moves to a photosensitive drum 1*a* during a primary transferring step is a secondary transfer residual toner that has been charged by the electroconductive brush 16 to which the first set current has been applied.

(2) The secondary transfer residual toner which moves to the photosensitive drum 1*a* after the primary transferring step has been completed is a secondary transfer residual toner which has been charged by the electroconductive brush 16 to which the second set current has been applied.

The surface potential of the photosensitive drum 1*a* is controlled so as to move the secondary transfer residual toner which has been charged by the electroconductive brush 16 to which the second set current has been applied.

Figure 10:
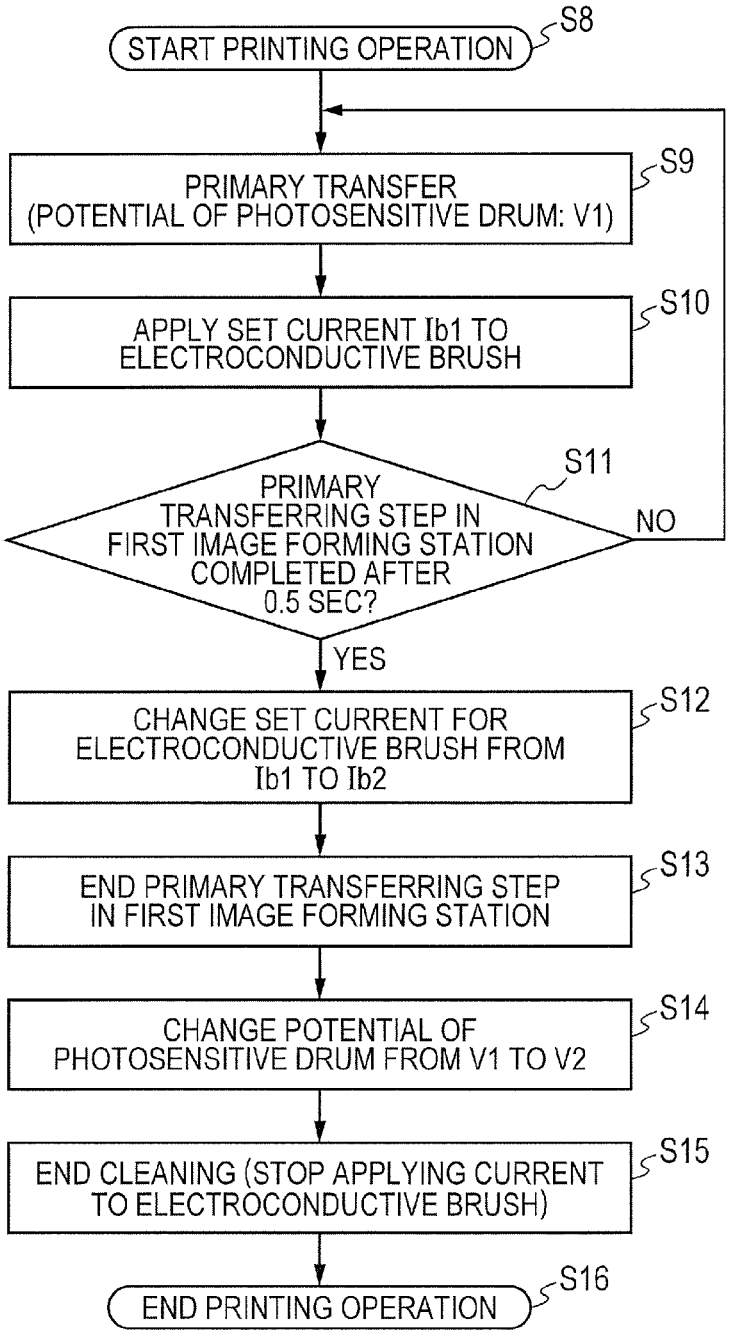
FIG. 10 is a flow chart illustrating an operation of an electroconductive brush during a printing operation in Exemplary Embodiment 2.

A specific operation of the electroconductive brush 16 during the printing operation will be described below with reference to FIG. 2 and a flow chart illustrated in FIG. 10. FIG. 10 illustrates the flow chart illustrating the processing which is carried out by a control portion 104 in an image forming apparatus 100 of the present exemplary embodiment. S8 to S10 are the same steps as S1 to S3 which have been described in Exemplary Embodiment 1. In S11, it is determined whether the secondary transfer residual toner which is passing through the electroconductive brush 16 is reversely transferred to the photosensitive drum 1*a* in the primary transferring step or not. Specifically, when a distance between the electroconductive brush 16 and the photosensitive drum 1*a* is 50 mm and a peripheral speed of the intermediate transfer belt 10 is 100 mm/sec, the secondary transfer residual toner which is passing through the electroconductive brush 16 needs a period of time of 0.5 sec until reaching the photosensitive drum 1*a*. Because of this, it is determined from a remaining print range whether the photosensitive drum 1*a* is conducting the primary transferring step after 0.5 sec or not. When it is determined that the primary transferring step will be being conducted after 0.5 sec, and that the secondary transfer residual toner which is passing through the electroconductive brush 16 will be reversely transferred to the photosensitive drum 1*a* in the primary transferring step, the steps of S9 and S10 are repeated. When it is determined that the primary transferring step will be completed after 0.5 sec, and that the secondary transfer residual toner which is passing through the electroconductive brush 16 will be reversely transferred to the photosensitive drum 1*a* which will have completed the primary transferring step, the set current for the electroconductive brush 16 is changed to Ib2, in S12.

In S13, the primary transferring step of the first image forming station a is completed, and in S14, an average potential of the surface of the photosensitive drum 1*a* is controlled to become V2. In S15, after the whole of the secondary transfer residual toner has passed through the electroconductive brush 16 and has been removed from the surface of the intermediate transfer belt 10, the application of the current to the electroconductive brush 16 is stopped. In S16, the printing operation is completed.

In S14, an average potential V2 of the surface of the photosensitive drum 1*a* is set at −500 [V] which is the same potential as the potential Vd of the dark portion. At this time, the second set current Ib2 which is applied to the electroconductive brush 16 is 5 [μA]. In S14 and S15, the secondary transfer residual toner that has passed through the electroconductive brush 16 to which the set current Ib2 has been applied is charged to the positive polarity, and the toner that has not been completely charged is primarily collected in the electroconductive brush 16, which are similar to those in Exemplary Embodiment 1. After that, the charged secondary transfer residual toner is reversely transferred to the photosensitive drum 1*a* of which the average potential of the surface has been controlled to V2, is removed from the surface of the photosensitive drum 1*a* by the cleaning device 5*a*, and is collected therein.

(Action of Present Exemplary Embodiment)

Next, an action of the present exemplary embodiment will be described below. In the present exemplary embodiment, the image forming apparatus has an action of reducing the amount of the toners deposited on the brush by lowering the set current for the electroconductive brush 16, and an action of maintaining the stable cleaning performance by controlling the surface potential of the photosensitive drum 1*a*, which are the same contents as described in Exemplary Embodiment 1. For this reason, the description will be omitted.

In Exemplary Embodiment 1, the set current for the electroconductive brush 16 is changed when the whole of the primary transferring step has been completed. Because of this, as the distance of the intermediate transfer belt from the downstream side of the fourth image forming station d to the upstream side of the electroconductive brush 16 becomes short, the period of time during which the set current Ib2 is applied to the electroconductive brush 16 becomes short, and the action of reducing the amount of the toner deposited on the brush is weakened.

In contrast to this, in the present exemplary embodiment, the secondary transfer residual toner which is reversely transferred to the photosensitive drum 1*a* during the primary transferring step is determined to be the secondary transfer residual toner that has been charged by the electroconductive brush 16 to which the first set current Ib1 has been applied. Furthermore, the secondary transfer residual toner which is reversely transferred to the photosensitive drum 1*a* after the primary transferring step has been completed is determined to be the secondary transfer residual toner which has been charged by the electroconductive brush 16 to which the second set current Ib2 has been applied.

In the present exemplary embodiment, the set current for the electroconductive brush 16 is changed from the first set current Ib1 to the second set current Ib2, during the printing operation. Because of this, it is enabled to extend the period of time for applying the set current Ib2 to the electroconductive brush 16, regardless of the arrangements of the fourth image forming station d and the electroconductive brush 16. Thereby, it is enabled to maintain the cleaning performance more effectively and stably compared to Exemplary Embodiment 1.

Exemplary Embodiment 3

Exemplary Embodiment 3 will be described below. Incidentally, in the present exemplary embodiment, a structural part different from that in Exemplary Embodiments 1 and 2 will be described, and a description on a structural part similar to that in Exemplary Embodiments 1 and 2 will be omitted.

(Features of Present Exemplary Embodiment)

In Exemplary Embodiments 1 and 2, a current supplied to the electroconductive brush 16 by the high-voltage power source 60 has been changed, but in the present exemplary embodiment, a voltage applied to the electroconductive brush 16 by the high-voltage power source is changed. Specifically, the present exemplary embodiment is characterized in that a control as is described below is conducted in the image forming apparatus 100 illustrated in FIG. 2. Firstly, after the whole of the primary transferring step during the printing operation has been completed, the set voltage for the electroconductive brush 16 is changed from a first set voltage (first voltage) to a second set voltage (second voltage) which is smaller than the first set voltage. After that, the surface potential of the photosensitive drum 1*a* is controlled so that the secondary transfer residual toner which has been charged by the electroconductive brush 16 to which the second set voltage has been applied is reversely transferred to the photosensitive drum 1*a*. The first set voltage and the second set voltage correspond to a voltage of a first value which is set when the image formation is started and a voltage of a second value which is smaller than the first value, respectively, out of the set values of the voltage which is applied to the electroconductive brush 16 by the high-voltage power source 60. The high-voltage power source 60 is provided so as to be capable of changing the set value of the voltage to be applied to the electroconductive brush 16, from the first value to the second value, by the control portion 104, at a previously set timing after the image formation for one sheet of a recording material has been started.

Figure 11:
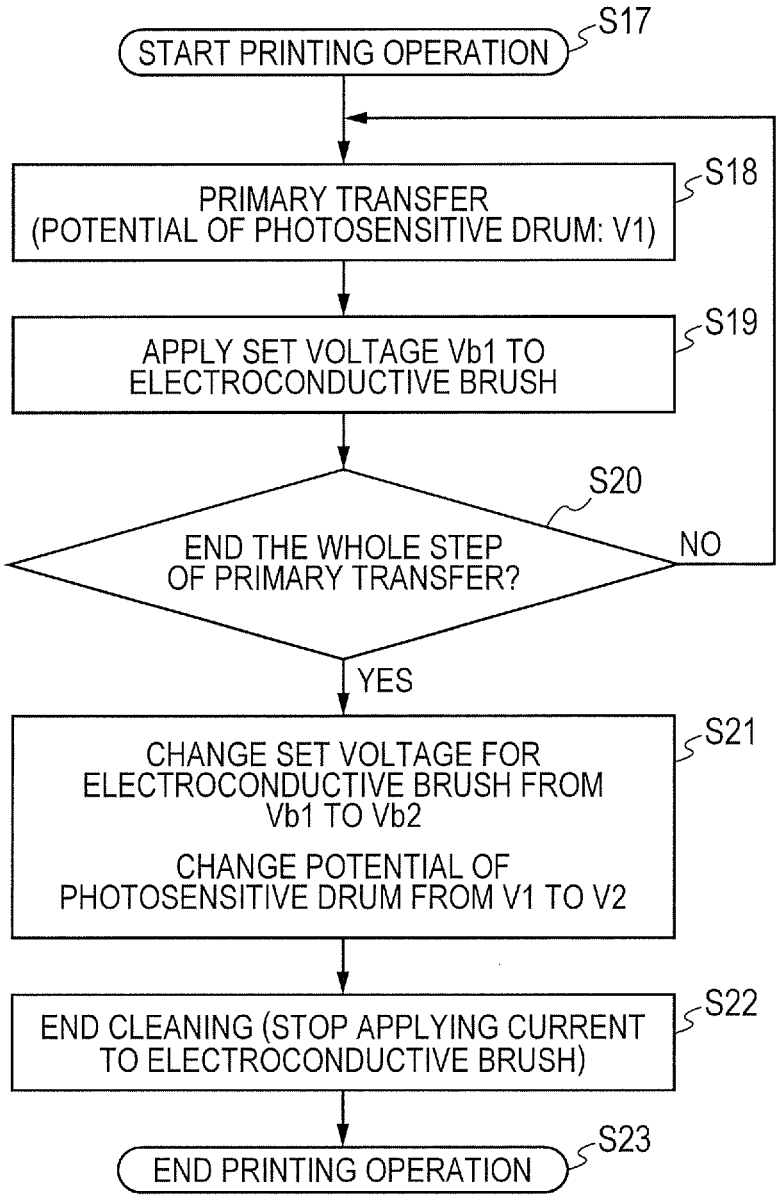
FIG. 11 is a flow chart illustrating an operation of an electroconductive brush during a printing operation in Exemplary Embodiment 3.

A specific operation of the electroconductive brush 16 during the printing operation will be described with reference to FIG. 2 and a flow chart illustrated in FIG. 11. FIG. 11 illustrates the flow chart illustrating the processing which is carried out by a control portion 104 in an image forming apparatus 100 of the present exemplary embodiment. S17 and S18 are the same steps as S1 and S2 which have been described in Exemplary Embodiment 1. In S19, the first set voltage Vb1 is applied to the electroconductive brush 16. In S20, it is determined whether the primary transferring step in the fourth image forming station d has been completed. When the primary transferring step has not been completed, the above described steps of S18 and S19 are repeated. When the whole of the primary transferring step of the fourth image forming station d has been completed, the control portion changes the set voltage for the electroconductive brush 16 to the second set voltage Vb2, and controls so that the average potential of the surface of the photosensitive drum 1*a* becomes V2, in S21. In S22, after the secondary transfer residual toner has passed through the electroconductive brush 16 and has been removed from the surface of the intermediate transfer belt 10, the application of the voltage to the electroconductive brush 16 is stopped. In S23, the printing operation is completed.

In S18, the average potential V1 of the surface of the photosensitive drum 1*a* becomes −300 [V], which is similar to that in Exemplary Embodiment 1. The first set voltage Vb1 which is applied to the electroconductive brush is set at 1,500 [V]. In S18 and S19, when passing through the electroconductive brush 16 to which the first set voltage Vb1 is applied, the secondary transfer residual toner therethrough is charged to the positive polarity, and the toner which has not been completely charged is primarily collected in the electroconductive brush 16. After that, the charged secondary transfer residual toner is reversely transferred to the photosensitive drum 1*a* of which the average potential of the surface is V1, is removed from the surface of the photosensitive drum 1*a* by the cleaning device 5*a*, and is collected therein. At this time, in the first image forming station a, the toner image on the photosensitive drum 1*a* is transferred onto the intermediate transfer belt 10, and at the same time, cleaning simultaneous with transfer is conducted to collect the secondary transfer residual toner.

In S21, the average potential V2 of the surface of the photosensitive drum 1*a* is set at −500 [V] which is the same potential as the potential Vd of the dark portion, and the second set voltage Vb2 which is applied to the electroconductive brush 16 is set at 1,000 [V]. In S21 and S22, the secondary transfer residual toner that has passed through the electroconductive brush 16 to which the set voltage Vb2 has been applied is charged to the positive polarity, and the toner that has not been completely charged is primarily collected in the electroconductive brush 16, which are similar to those in Exemplary Embodiment 1. After that, the charged secondary transfer residual toner is reversely transferred to the photosensitive drum 1*a* of which the average potential of the surface has been controlled to V2, is removed from the surface of the photosensitive drum 1*a* by the cleaning device 5*a*, and is collected therein.

The timing at which the set voltage for the electroconductive brush 16 is changed from the first set voltage Vb1 to the second set voltage Vb2 may be set so as to be the following state (similarly to that in Exemplary Embodiment 2). Firstly, a secondary transfer residual toner which is reversely transferred to the photosensitive drum 1*a* during a primary transferring step is a secondary transfer residual toner that has been charged by the electroconductive brush 16 to which the first set voltage Vb1 has been applied. Furthermore, the secondary transfer residual toner which is reversely transferred to the photosensitive drum 1*a* after the primary transferring step has been completed is determined to be the secondary transfer residual toner which has been charged by the electroconductive brush 16 to which the second set voltage has been applied.

(Action of Present Exemplary Embodiment)

Next, an action of the present exemplary embodiment will be described below. The relationship between the set voltage for the electroconductive brush 16 and the amount of the deposited secondary transfer residual toners will be described below. As illustrated in Exemplary Embodiment 1, as a potential difference Vb [V] between potentials at the tip and the root of the electroconductive brush 16 becomes large, the force of electrostatically attracting the toner becomes strong, and the secondary transfer residual toner deposits on the brush tip and even onto the root of the electroconductive brush 16. On the contrary, as the potential difference Vb which is applied to the electroconductive brush 16 is small, the force of electrostatically attracting the toner becomes weak, and the amount of toners deposited on the root of the electroconductive brush 16 decreases. Accordingly, when the set voltage for the electroconductive brush 16 is changed from Vb1 to Vb2 which is smaller than Vb1, during the printing operation, the amount of toners deposited on the electroconductive brush 16 can be reduced by such an extent that the set voltage has been decreased to Vb2. The relationship between a resistance value Rb [Ω] of the electroconductive brush 16 and a resistance value Ri [Ω] of the intermediate transfer belt 10 may also be similar to that in Exemplary Embodiment 1.

Next, a cleaning operation corresponding to each of the set voltages to be applied to the electroconductive brush 16 will be described below. The secondary transfer residual toner that has passed through the electroconductive brush 16 to which the first set voltage Vb1 has been applied and that has been charged to the positive polarity must be reversely transferred to the photosensitive drum 1*a*, even in a state in which the potential difference between potentials of the photosensitive drum 1*a* and the intermediate transfer belt 10 is minimum. Because of this, the set voltage Vb1 must be set at such a value as to satisfy the above described state, and in the present exemplary embodiment, the value is set at 1,500 [V]. The second set voltage Vb2 is 1,000 [V] which is smaller than Vb1, and accordingly the charge amount of the secondary transfer residual toner is small compared to that in the case where the set voltage Vb1 is applied to the electroconductive brush 16. Because of this, the potential difference generated between the photosensitive drum 1*a* and the intermediate transfer belt 10 needs to be increased to compensate the force which is received when being reversely transferred to the photosensitive drum 1*a*. In the present exemplary embodiment, the average potential V2 of the surface of the photosensitive drum 1*a* is set at −500 [V] to increase the potential difference generated between the photosensitive drum 1*a* and the intermediate transfer belt 10.

As described above, in the present exemplary embodiment, when the whole of the primary transferring step during the printing operation has been completed, the set voltage for the electroconductive brush 16 is changed from Vb1 to Vb2 which is smaller than Vb1. Thereby, the amount of deposited toners on the electroconductive brush 16 is reduced, and an apparent increase of the resistance of the electroconductive brush 16 due to endurance running can be suppressed. At this time, there is a concern that the secondary transfer residual toner that has passed through the electroconductive brush 16 to which the set voltage Vb2 has been applied is insufficiently charged, but the secondary transfer residual toner can be reversely transferred by controlling the surface potential of the photosensitive drum 1*a*. Thus, even the secondary transfer residual toner having a small charge amount can be reversely transferred to the photosensitive drum, and accordingly the cleaning performance can be maintained more stably. Accordingly, also in the present exemplary embodiment, the effect similar to that in Exemplary Embodiments 1 and 2 can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-121214, filed May 28, 2012, which is hereby incorporated by reference herein in its entirety.

What is claimed is:

1. An image forming apparatus comprising:

an image bearing member configured to bear a toner image;

an endless and movable intermediate transfer member from which the toner image, that has been primarily transferred to the intermediate transfer member from the image bearing member in a primary transfer portion, is secondarily transferred to a recording material in a secondary transfer portion;

a charging device which is arranged at an upstream side of the primary transfer portion and a downstream side of the secondary transfer portion in a moving direction of the intermediate transfer member and enabled to charge residual toner on the intermediate transfer member, the charging device including a supporting portion and a brush member that is supported by the supporting portion so as not to be rotated while the intermediate transfer member moves, the charging device having electroconductivity and coming in contact with the intermediate transfer member;

a power source portion which applies voltage to the charging device in a predetermined range; and a control unit configured to change voltage to be applied to the charging device from the power source portion so that a current that flows in the charging device becomes a predetermined current value, and further control a potential difference between potentials of the image bearing member and the intermediate transfer member in the primary transfer portion, wherein the control unit is configured to set a first current value as the predetermined current value before the toner image is primarily transferred from the image bearing member to the intermediate transfer member, and to set a second current value, which has a polarity same as the first current value and an absolute value smaller than that of the first current value, as the predetermined current value after the toner image is primarily transferred from the image bearing member to the intermediate transfer member, and wherein the control unit is configured to change the potential difference from a first potential difference to a second potential difference, which is greater than the first potential difference, concurrently with changing the first current value to the second current value.

2. The image forming apparatus according to claim 1, wherein the first current value is set so that movement of the toner image to the intermediate transfer member from the image bearing member by primary transfer and movement of the residual toner to the image bearing member from the intermediate transfer member are enabled to be simultaneously performed in the primary transfer portion.

3. The image forming apparatus according to claim 1, further comprising an exposure unit which exposes the image bearing member, wherein the control unit sets the potential difference between potentials of the image bearing member and the intermediate transfer member so as to be greater in the case when not exposing the image bearing member with the exposure unit than that in the case when the image bearing member is exposed.

4. The image forming apparatus according to claim 1, wherein the brush member and the intermediate transfer member are configured so as to satisfy the relationship of $Rb \geq Ri$, when electric resistance values of the brush member and the intermediate transfer member in a region in which the brush member and the intermediate transfer member come in contact with each other are represented by Rb [Ω] and Ri [Ω], respectively.

5. The image forming apparatus according to claim 1, wherein a plurality of the image bearing members is arranged along a moving direction of the intermediate transfer member.

6. An image forming apparatus comprising:

an image bearing member configured to bear a toner image;

an endless and movable intermediate transfer member from which a toner image, that has been primarily transferred to the intermediate transfer member from the image bearing member in a primary transfer portion, is secondarily transferred to a recording material in a secondary transfer portion;

a charging device which is arranged at an upstream side of the primary transfer portion and a downstream side of the secondary transfer portion in a moving direction of the intermediate transfer member and enabled to charge residual toner on the intermediate transfer member, the charging device including a supporting portion and a brush member that is supported by the supporting portion so as not to be rotated while the intermediate transfer member moves, the charging device having electroconductivity and coming in contact with the intermediate transfer member;

a power source portion which applies voltage to the charging device in a predetermined range; and a control unit configured to control a potential difference between potentials of the image bearing member and the intermediate transfer member in the primary transfer portion, the control portion configured to set at least a first voltage and a second voltage, which has an absolute value smaller than that of the first voltage, as a voltage when charging the residual toner, wherein the control unit is configured to set the first voltage before the toner image is primarily transferred from the image bearing member to the intermediate transfer member, and to set the second voltage after the toner image is primarily transferred from the image bearing member to the intermediate transfer member, and wherein the control unit is configured to change the potential difference from a first potential difference to a second potential difference, which is greater than the first potential difference, concurrently with changing the first voltage to the second voltage.

7. The image forming apparatus according to claim 6, wherein the first voltage is set so that movement of the toner image to the intermediate transfer member from the image bearing member by primary transfer and movement of the residual toner to the image bearing member from the intermediate transfer member are enabled to be simultaneously performed in the primary transfer portion.

8. The image forming apparatus according to claim 6, further comprising an exposure unit which exposes the image bearing member, wherein the control unit sets the potential difference between potentials of the image bearing member and the intermediate transfer member so as to be greater in the case when not exposing the image bearing member with the exposure unit than that in the case when the image bearing member is exposed.

9. The image forming apparatus according to claim 6, wherein the brush member and the intermediate transfer member are structured so as to satisfy the relationship of $Rb \geq Ri$, when electric resistance values of the brush member and the intermediate transfer member in a region in which the brush member and the intermediate transfer member come in contact with each other are represented by Rb [Ω] and Ri [Ω], respectively.

10. The image forming apparatus according to claim 6, wherein a plurality of the image bearing members is arranged along a moving direction of the intermediate transfer member.

* * * * *